US009342956B2

(12) United States Patent
Hughes

(10) Patent No.: US 9,342,956 B2
(45) Date of Patent: May 17, 2016

(54) GAMING SYSTEM, GAMING DEVICE AND METHOD FOR SHIFTING PROGRESSIVE AWARD CONTRIBUTION RATES

(75) Inventor: William Keith Hughes, Reno, NV (US)

(73) Assignee: IGT, Las Vegas, NV (US)

( * ) Notice: Subject to any disclaimer, the term of this patent is extended or adjusted under 35 U.S.C. 154(b) by 406 days.

(21) Appl. No.: 13/404,229

(22) Filed: Feb. 24, 2012

(65) Prior Publication Data

US 2013/0225277 A1 Aug. 29, 2013

(51) Int. Cl.

| | |
|---|---|
| ***A63F 9/24*** | (2006.01) |
| ***G07F 17/32*** | (2006.01) |
| *G07F 17/34* | (2006.01) |

(52) U.S. Cl.

CPC ..... *G07F 17/3258* (2013.01); *G07F 17/34* (2013.01)

(58) Field of Classification Search

USPC ..... 463/27, 29, 30, 32

See application file for complete search history.

(56) References Cited

U.S. PATENT DOCUMENTS

| | | | |
|---|---|---|---|
| 5,116,055 | A | 5/1992 | Tracy |
| 5,158,293 | A | 10/1992 | Mullins |
| 5,275,400 | A | 1/1994 | Weingardt |
| 5,280,909 | A | 1/1994 | Tracy |
| 5,324,035 | A | 6/1994 | Morris et al. |
| 5,326,104 | A | 7/1994 | Pease et al. |
| 5,344,144 | A | 9/1994 | Canon |
| 5,364,104 | A | 11/1994 | Jones et al. |
| 5,377,973 | A | 1/1995 | Jones et al. |
| 5,423,539 | A | 6/1995 | Nagao |
| 5,476,259 | A | 12/1995 | Weingardt |
| 5,560,603 | A | 10/1996 | Seelig et al. |
| 5,655,961 | A | 8/1997 | Acres et al. |
| 5,741,183 | A | 4/1998 | Acres et al. |
| 5,752,882 | A | 5/1998 | Acres et al. |
| 5,766,076 | A | 6/1998 | Pease et al. |
| 5,769,716 | A | 6/1998 | Saffari et al. |
| RE35,864 | E | 7/1998 | Weingardt |
| 5,779,549 | A | 7/1998 | Walker et al. |
| 5,836,817 | A | 11/1998 | Acres et al. |
| 5,851,148 | A | 12/1998 | Brune et al. |
| 5,851,149 | A | 12/1998 | Xidos et al. |
| 5,855,515 | A | 1/1999 | Pease et al. |
| 5,876,284 | A | 3/1999 | Acres et al. |

(Continued)

FOREIGN PATENT DOCUMENTS

| | | |
|---|---|---|
| AU | 711501 | 10/1999 |
| GB | 2137392 A | 10/1984 |

(Continued)

OTHER PUBLICATIONS

Extended European Search Report dated Apr. 29, 2013 for European Application No. 1315571.0, (6 pages).

*Primary Examiner* — Paul A D'Agostino
*Assistant Examiner* — Brandon Gray
(74) *Attorney, Agent, or Firm* — Neal, Gerber & Eisenberg LLP

(57) ABSTRACT

A gaming system and method which maintains a plurality of progressive awards. Each progressive award is associated with a progressive award contribution rate wherein at least two of the maintained progressive awards are associated with different progressive award contribution rates. Upon an occurrence of a progressive award contribution rate reconfiguration event, the gaming system shifts, modifies or changes which progressive awards are associated with which progressive award contribution rates.

30 Claims, 7 Drawing Sheets

(56) References Cited

U.S. PATENT DOCUMENTS

| | | | |
|---|---|---|---|
| 5,885,158 | A | 3/1999 | Torango et al. |
| 5,947,820 | A | 9/1999 | Morro et al. |
| 5,997,400 | A | 12/1999 | Seelig et al. |
| 6,001,016 | A | 12/1999 | Walker et al. |
| 6,012,982 | A | 1/2000 | Piechowiak et al. |
| 6,012,983 | A | 1/2000 | Walker et al. |
| 6,089,980 | A | 7/2000 | Gauselmann |
| 6,099,408 | A | 8/2000 | Schneier et al. |
| 6,110,041 | A | 8/2000 | Walker et al. |
| 6,110,043 | A | 8/2000 | Olsen |
| 6,135,884 | A | 10/2000 | Hedrick et al. |
| 6,142,872 | A | 11/2000 | Walker et al. |
| 6,159,098 | A | 12/2000 | Slomiany et al. |
| 6,162,121 | A | 12/2000 | Morro et al. |
| 6,162,122 | A | 12/2000 | Acres et al. |
| 6,168,520 | B1 | 1/2001 | Baerlocher et al. |
| 6,186,894 | B1 | 2/2001 | Mayeroff |
| 6,190,255 | B1 | 2/2001 | Thomas et al. |
| 6,203,010 | B1 | 3/2001 | Jorasch et al. |
| 6,203,430 | B1 | 3/2001 | Walker et al. |
| 6,210,275 | B1 | 4/2001 | Olsen |
| 6,224,483 | B1 | 5/2001 | Mayeroff |
| 6,231,445 | B1 | 5/2001 | Acres |
| 6,241,608 | B1 | 6/2001 | Torango |
| 6,244,958 | B1 | 6/2001 | Acres |
| 6,254,483 | B1 | 7/2001 | Acres |
| 6,257,981 | B1 | 7/2001 | Acres et al. |
| RE37,414 | E | 10/2001 | Harlick |
| 6,312,333 | B1 | 11/2001 | Acres |
| 6,319,125 | B1 | 11/2001 | Acres |
| 6,364,768 | B1 | 4/2002 | Acres et al. |
| 6,371,852 | B1 | 4/2002 | Acres |
| 6,375,567 | B1 | 4/2002 | Acres |
| 6,375,569 | B1 | 4/2002 | Acres |
| 6,431,983 | B2 | 8/2002 | Acres |
| 6,435,511 | B1 | 8/2002 | Vancura et al. |
| 6,435,968 | B1 | 8/2002 | Torango |
| RE37,885 | E | 10/2002 | Acres et al. |
| 6,565,434 | B1 | 5/2003 | Acres |
| 6,589,115 | B2 | 7/2003 | Walker et al. |
| 6,599,193 | B2 | 7/2003 | Baerlocher et al. |
| 6,607,438 | B2 | 8/2003 | Baerlocher et al. |
| 6,626,758 | B1 | 9/2003 | Parham et al. |
| 6,648,757 | B1 | 11/2003 | Slomiany et al. |
| 6,656,052 | B2 | 12/2003 | Abramopoulos et al. |
| 6,712,697 | B2 | 3/2004 | Acres |
| 6,800,030 | B2 | 10/2004 | Acres |
| 6,832,958 | B2 | 12/2004 | Acres et al. |
| 6,869,361 | B2 | 3/2005 | Sharpless et al. |
| 6,887,154 | B1 | 5/2005 | Luciano, Jr. et al. |
| 6,899,625 | B2 | 5/2005 | Luciano, Jr. et al. |
| 6,908,387 | B2 | 6/2005 | Hedrick et al. |
| 6,910,964 | B2 | 6/2005 | Acres |
| RE38,812 | E | 10/2005 | Acres et al. |
| 7,056,215 | B1 | 6/2006 | Olive |
| 7,070,505 | B2 | 7/2006 | Vancura et al. |
| 7,273,415 | B2 | 9/2007 | Cregan et al. |
| 7,297,059 | B2 | 11/2007 | Vancura et al. |
| 7,357,716 | B2 | 4/2008 | Marks et al. |
| 7,597,621 | B2 | 10/2009 | Baerlocher |
| 7,651,392 | B2 | 1/2010 | Pennington et al. |
| 7,651,394 | B2 | 1/2010 | Johnson |
| 7,666,093 | B2 | 2/2010 | Lafky et al. |
| 7,713,120 | B2 | 5/2010 | Cannon |
| 7,780,520 | B2 | 8/2010 | Baerlocher |
| 7,914,377 | B2 | 3/2011 | Benbrahim et al. |
| 7,931,532 | B2 | 4/2011 | Johnson |
| 7,942,737 | B2 | 5/2011 | Cregan et al. |
| 7,963,845 | B2 | 6/2011 | Baerlocher |
| 2002/0071557 | A1 | 6/2002 | Nguyen |
| 2002/0116615 | A1 | 8/2002 | Nguyen et al. |
| 2002/0138594 | A1 | 9/2002 | Rowe |
| 2002/0151354 | A1 | 10/2002 | Boesen et al. |
| 2002/0187834 | A1 | 12/2002 | Rowe et al. |
| 2003/0027625 | A1 | 2/2003 | Rowe |
| 2003/0030211 | A1 | 2/2003 | Brown |
| 2003/0060266 | A1 | 3/2003 | Baerlocher |
| 2003/0060269 | A1 | 3/2003 | Paulsen et al. |
| 2003/0060279 | A1 | 3/2003 | Torango |
| 2003/0216166 | A1 | 11/2003 | Baerlocher et al. |
| 2003/0222402 | A1 | 12/2003 | Olive |
| 2004/0009811 | A1 | 1/2004 | Torango |
| 2004/0048644 | A1 | 3/2004 | Gerrard et al. |
| 2005/0059467 | A1 | 3/2005 | Saffari et al. |
| 2005/0119047 | A1 | 6/2005 | Olive |
| 2005/0143168 | A1 | 6/2005 | Torango |
| 2005/0176488 | A1 | 8/2005 | Olive |
| 2005/0209004 | A1 | 9/2005 | Torango |
| 2006/0030403 | A1 | 2/2006 | Lafky et al. |
| 2006/0035694 | A1 | 2/2006 | Fuller |
| 2006/0040732 | A1 | 2/2006 | Baerlocher et al. |
| 2006/0073887 | A1 | 4/2006 | Nguyen et al. |
| 2006/0142079 | A1 | 6/2006 | Ikehara et al. |
| 2006/0183535 | A1 | 8/2006 | Marks et al. |
| 2006/0183538 | A1 | 8/2006 | Michaelson et al. |
| 2006/0236116 | A1 | 10/2006 | Patel |
| 2006/0287077 | A1 | 12/2006 | Grav et al. |
| 2007/0054733 | A1 | 3/2007 | Baerlocher |
| 2007/0060271 | A1 | 3/2007 | Cregan et al. |
| 2007/0060320 | A1 | 3/2007 | Kelly et al. |
| 2007/0060321 | A1 | 3/2007 | Vasquez et al. |
| 2007/0105620 | A1 | 5/2007 | Cuddy et al. |
| 2007/0184887 | A1 | 8/2007 | Cannon |
| 2007/0191088 | A1 | 8/2007 | Breckner et al. |
| 2007/0202943 | A1 | 8/2007 | Thomas |
| 2007/0213114 | A1 | 9/2007 | Caspers et al. |
| 2007/0218982 | A1 | 9/2007 | Baerlocher |
| 2007/0259709 | A1 | 11/2007 | Kelly et al. |
| 2007/0298875 | A1 | 12/2007 | Baerlocher et al. |
| 2008/0032782 | A1 | 2/2008 | Boesen et al. |
| 2008/0039191 | A1 | 2/2008 | Cuddy |
| 2008/0090651 | A1 | 4/2008 | Baerlocher |
| 2008/0108430 | A1 | 5/2008 | Evans |
| 2008/0108431 | A1 | 5/2008 | Cuddy et al. |
| 2008/0113779 | A1 | 5/2008 | Cregan |
| 2008/0139274 | A1 | 6/2008 | Baerlocher |
| 2008/0153564 | A1* | 6/2008 | Baerlocher et al. ..... 463/16 |
| 2008/0287185 | A1* | 11/2008 | Yoseloff ..... G07F 17/3258 463/27 |
| 2009/0042645 | A1 | 2/2009 | Graham et al. |
| 2009/0088244 | A1 | 4/2009 | Nicely et al. |
| 2009/0111561 | A1 | 4/2009 | Dewaal et al. |
| 2009/0124362 | A1 | 5/2009 | Cuddy et al. |
| 2009/0124363 | A1 | 5/2009 | Baerlocher et al. |
| 2009/0124364 | A1 | 5/2009 | Cuddy et al. |
| 2009/0233708 | A1 | 9/2009 | Kato |
| 2009/0275398 | A1* | 11/2009 | Nelson ..... 463/27 |
| 2010/0120498 | A1 | 5/2010 | Cuddy et al. |
| 2010/0261524 | A1 | 10/2010 | Pawloski et al. |
| 2011/0003637 | A1 | 1/2011 | LeFever |
| 2011/0014964 | A1* | 1/2011 | Crowder et al. ..... 463/13 |
| 2011/0053676 | A1 | 3/2011 | Wolf et al. |
| 2011/0111843 | A1 | 5/2011 | Nicely et al. |
| 2011/0118011 | A1 | 5/2011 | Filipour et al. |

FOREIGN PATENT DOCUMENTS

| | | |
|---|---|---|
| WO | WO 0012186 | 3/2000 |
| WO | WO 0032286 | 6/2000 |
| WO | WO 0207836 | 1/2002 |
| WO | WO 2005083599 | 9/2005 |
| WO | WO 2005099425 | 10/2005 |

* cited by examiner

FIG. 4

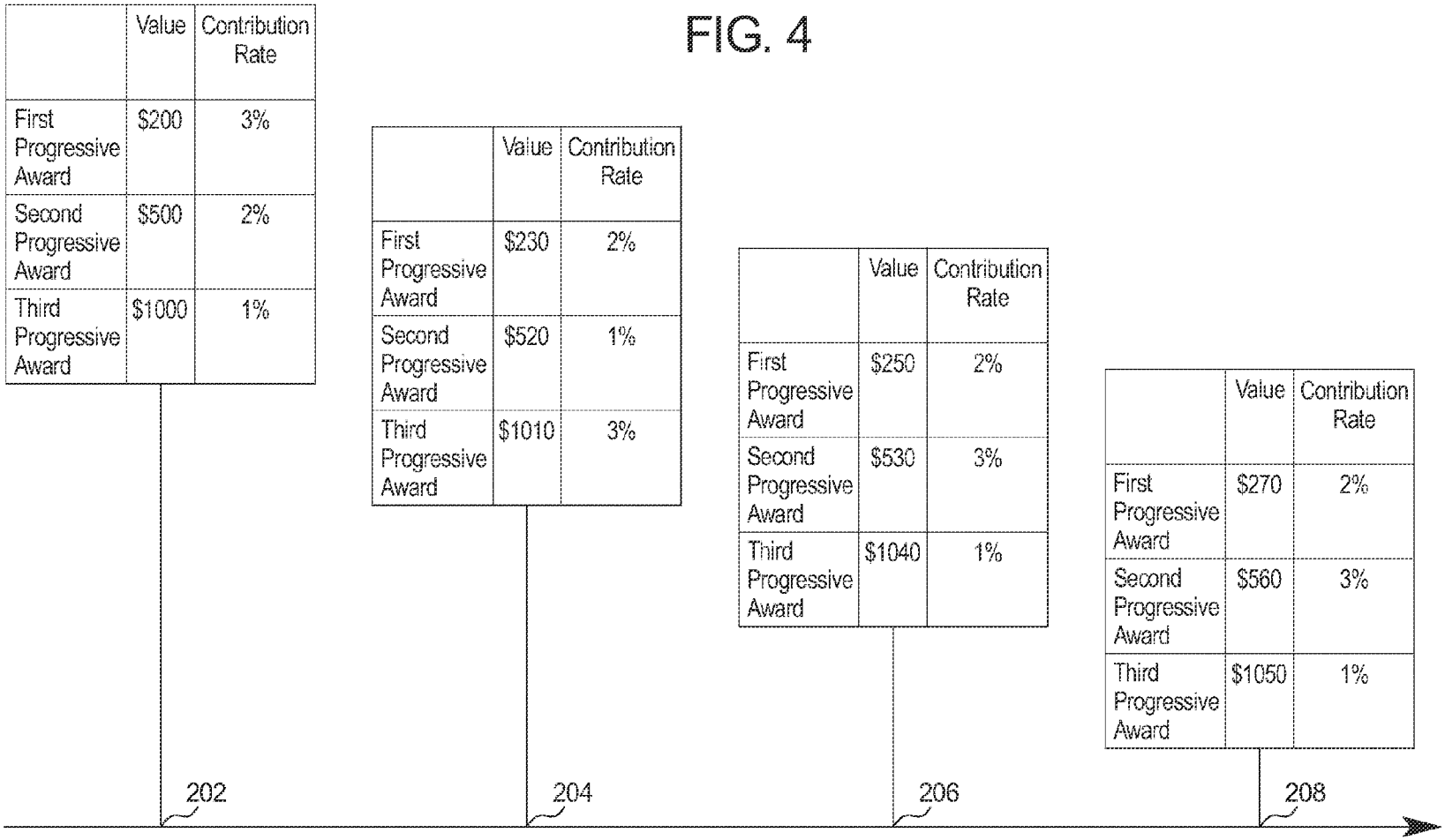

| | Value | Contribution Rate |
|---|---|---|
| First Progressive Award | $200 | 3% |
| Second Progressive Award | $500 | 2% |
| Third Progressive Award | $1000 | 1% |

| | Value | Contribution Rate |
|---|---|---|
| First Progressive Award | $230 | 2% |
| Second Progressive Award | $520 | 1% |
| Third Progressive Award | $1010 | 3% |

| | Value | Contribution Rate |
|---|---|---|
| First Progressive Award | $250 | 2% |
| Second Progressive Award | $530 | 3% |
| Third Progressive Award | $1040 | 1% |

| | Value | Contribution Rate |
|---|---|---|
| First Progressive Award | $270 | 2% |
| Second Progressive Award | $560 | 3% |
| Third Progressive Award | $1050 | 1% |

GAMING SYSTEM, GAMING DEVICE AND METHOD FOR SHIFTING PROGRESSIVE AWARD CONTRIBUTION RATES

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In such known gaming machines, the amount of the wager made on the base game by the player may vary. For instance, the gaming machine may enable the player to wager a minimum number of credits, such as one credit (e.g., one penny, nickel, dime, quarter or dollar) up to a maximum number of credits, such as five credits. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a triggering symbol or triggering symbol combination in the primary or base game. Part of the enjoyment and excitement of playing certain gaming machines is the occurrence or triggering of the secondary or bonus game (even before the player knows how much the bonus award will be).

Progressive awards associated with gaming machines are also known. In one form, a progressive award is an award amount which includes an initial amount funded by a casino and an additional amount funded through a portion of each wager made on the progressive gaming machines. For example, a progressive award increment rate of 0.1% of each wager placed on the primary games of the gaming machines associated with the progressive award may be allocated to the progressive award or progressive award fund or pool. The progressive award grows in value as more players play the gaming machines and more portions of these players' wagers are allocated to the progressive award. When a player obtains a winning symbol or winning symbol combination associated with the progressive award, the accumulated progressive award is provided to the player. After the progressive award is provided to the player, the amount of the next progressive award is reset to the initial value and a portion of each subsequent wager on a gaming machine associated with a progressive award is allocated to the next progressive award.

Moreover, a gaming machine or bank of gaming machines may be simultaneously associated with a plurality of progressive awards. In these multi-level progressive ("MLP") configurations, a plurality of progressive awards start at different award or value levels, wherein each of these progressive awards are associated with a different probability of being provided to a player. For certain MLP configurations, a plurality of the progressive awards increment at different progressive award contribution rates such that the different progressive awards increment, increase or grow at different rates until one of such progressive awards is provided to a player. For example, a gaming machine or bank of gaming machines maintains: (i) a first progressive award which has a start-up or reset value of $100, a first probability of being provided to a player, and a first progressive award contribution rate of 2% of each wager placed on the primary games of the gaming machine(s) associated with the first progressive award, and (ii) a second progressive award which has a start-up or reset value of $1000, a second, lower probability of being provided to a player and a second progressive award contribution rate of 1% of each wager placed on the primary games of the gaming machine(s) associated with the second progressive award. In this example, since the relatively larger second progressive award is associated with the relatively smaller second progressive award contribution rate, the increment or growth amount of this second progressive award (over a designated quantity of wagers placed) will be lower than the first progressive awards. As certain players play these gaming machines for a chance to win the top progressive award, these players may find this configuration undesirable.

One problem that exists with such known progressive award gaming systems is that if the progressive award is initially implemented in association with a relatively small number of gaming machines, the progressive award initially increments at a relatively slow growth or incremental rate. That is, without a relatively large number of players playing at gaming machines associated with the progressive award, the progressive award increments at an unattractive rate and takes a substantial period of time to climb to a high value. This situation may cause certain players not to play at the gaming machines associated with the progressive award because they do not find the progressive award desirable or worth the playing. Such players avoiding the gaming machines associated with the progressive award further slows the growth rate of the progressive award which in turn causes it to take a longer period of time for the progressive award to climb to a high value.

Another similar problem with known progressive award gaming systems is that after a progressive award is provided to one or more players, the next progressive award often takes a substantial period of time to climb back to a relatively high value. This discourages certain players who do not wish to play for a base or reset level progressive award. Such discouragement, often known as jackpot fatigue, can lead to players walking away from the gaming machines of the progressive award gaming system because they no longer find the progressive award desirable or worth the cost of continuing to play.

Accordingly, there is a continuing need to provide new and different gaming machines and gaming systems which provide one or more progressive awards to one or more players.

SUMMARY

The gaming system, gaming device and method disclosed herein generally relates to shifting one or more progressive award contribution rates for one or more maintained progressive awards.

In one embodiment, the gaming system maintains a plurality of progressive awards. Each progressive award is associated with a progressive award contribution rate wherein at least two of the maintained progressive awards are associated with different progressive award contribution rates. In this embodiment, upon an occurrence of a progressive award contribution rate reconfiguration event, the gaming system shifts, modifies or changes which progressive awards are associated with which progressive award contribution rates. For example, at a first point in time prior to the occurrence of a progressive award contribution rate reconfiguration event, the gaming system maintains: (i) a first progressive award which has a first progressive award contribution rate of 2% of each wager placed on the primary games of the gaming device(s) associated with the first progressive award, and (ii) a second progressive award which has a second progressive award contribution rate of 1% of each wager placed on the primary games of the gaming devices(s) associated with the second progressive award. In this example, upon the occurrence of a progressive award contribution rate reconfiguration event at a second, subsequent point in time, the gaming system modifies or reconfigures the progressive award contribution rates associated with the maintained progressive awards such that the first progressive award is reconfigured to have the second progressive award contribution rate of 1% of each wager placed on the primary games of the gaming device(s) associated with the first progressive award, and the second progressive award is reconfigured to have the first progressive award contribution rate of 2% of each wager placed on the primary games of the gaming devices(s) associated with the second progressive award. Such a configuration provides increased excitement and enjoyment for players because, upon an occurrence of a progressive award contribution rate reconfiguration event, one or more slower growing progressive awards, such as one or more slower growing-higher valued progressive awards, will become associated with increased progressive award contribution rates and thus grow in value at a more rapid rate. Such increased growth rate of such progressive awards counteracts jackpot fatigue and provides a more enjoyable and entertaining gaming experience for players.

Additional features and advantages are described in, and will be apparent from, the following Detailed Description and the figures.

BRIEF DESCRIPTION OF THE FIGURES

FIG. 4 is an example timeline of one embodiment of the gaming system disclosed herein illustrating a plurality of progressive awards having different progressive award contribution rates at different points in time.

DETAILED DESCRIPTION

The present disclosure may be implemented in various configurations for gaming machines, gaming devices, or gaming systems, including but not limited to: (1) a dedicated gaming machine, gaming device, or gaming system wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
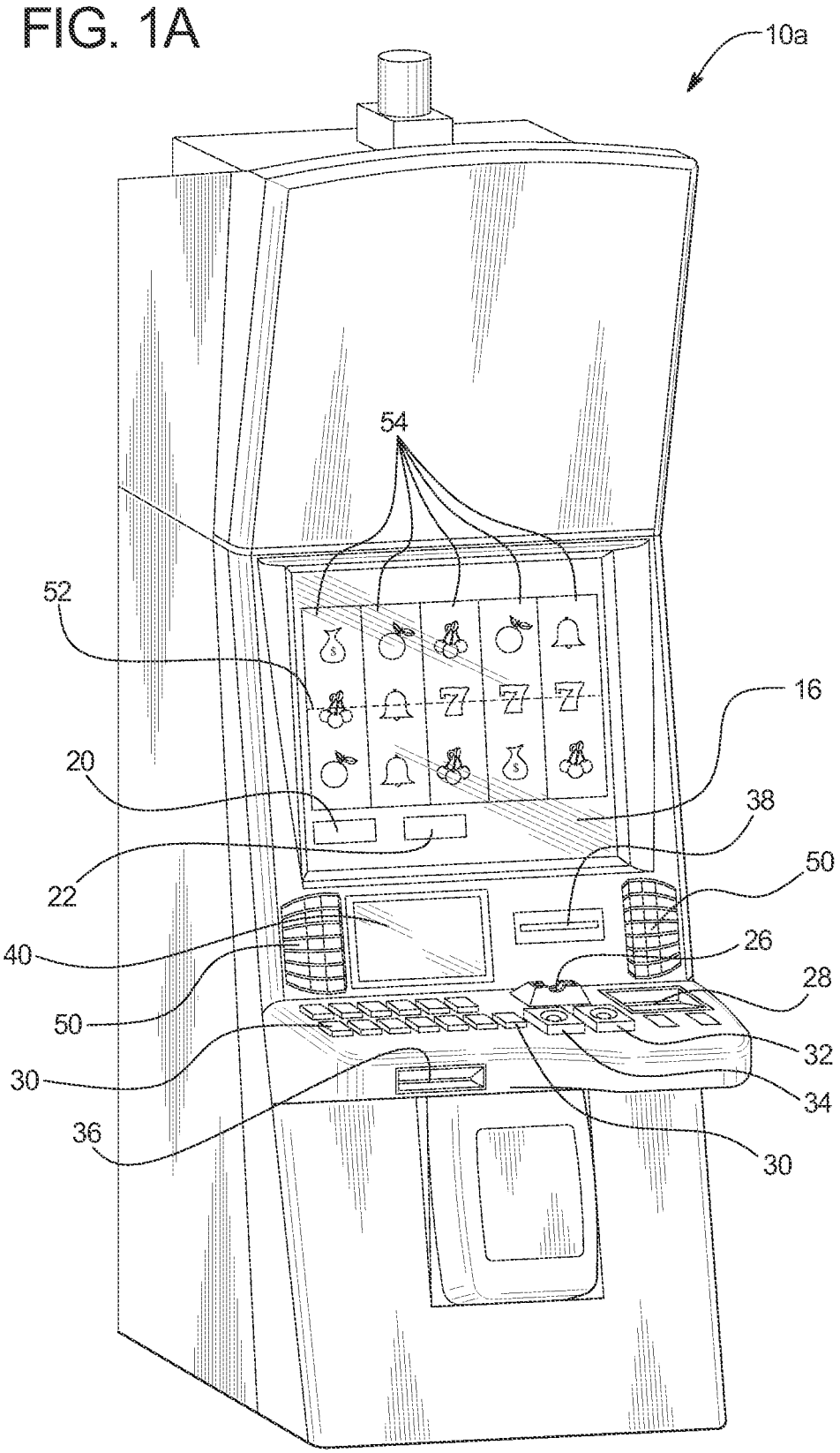
FIGS. 1A and 1B are front perspective views of alternative embodiments of gaming devices disclosed herein.
Figure 1B:
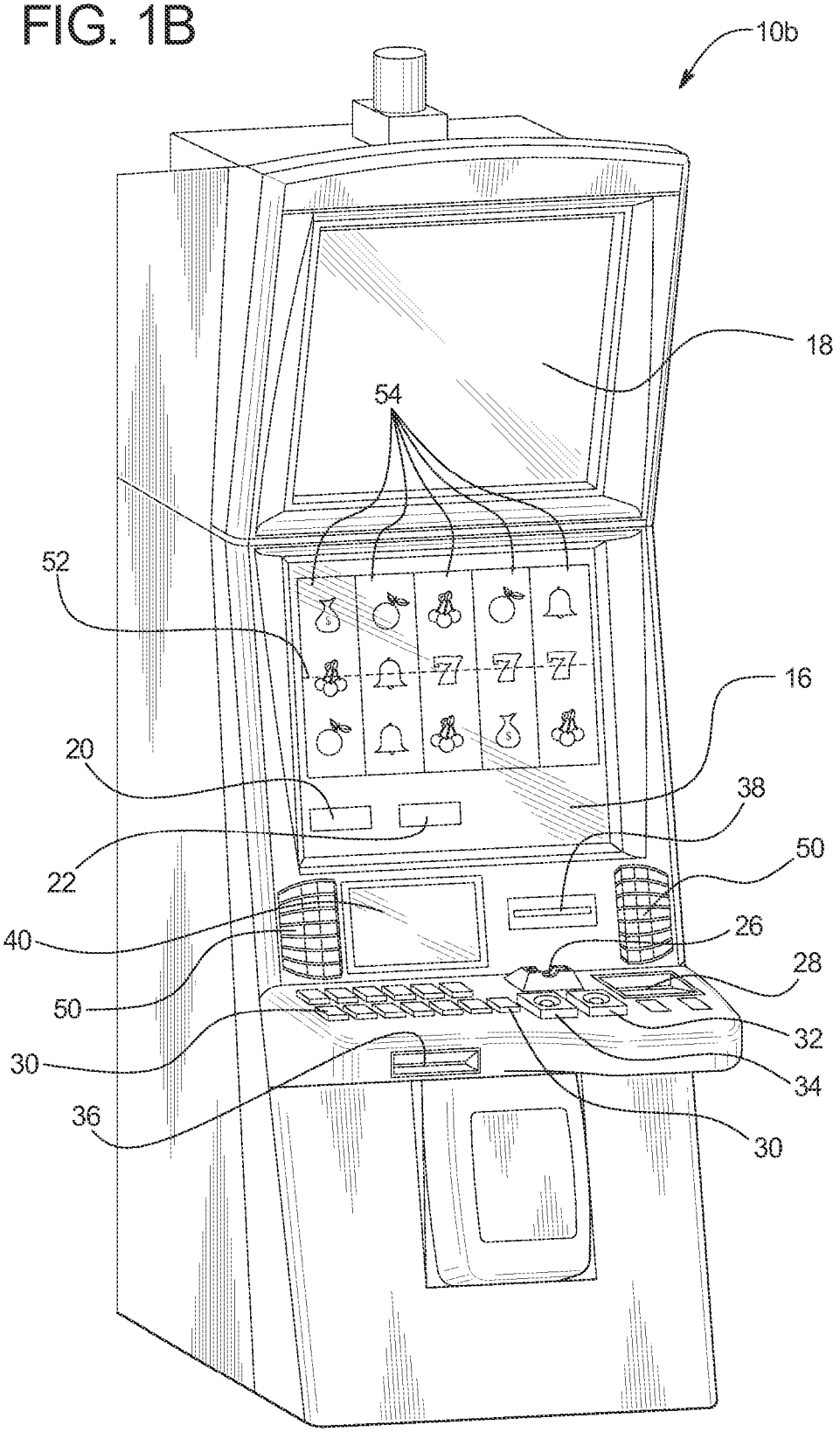

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
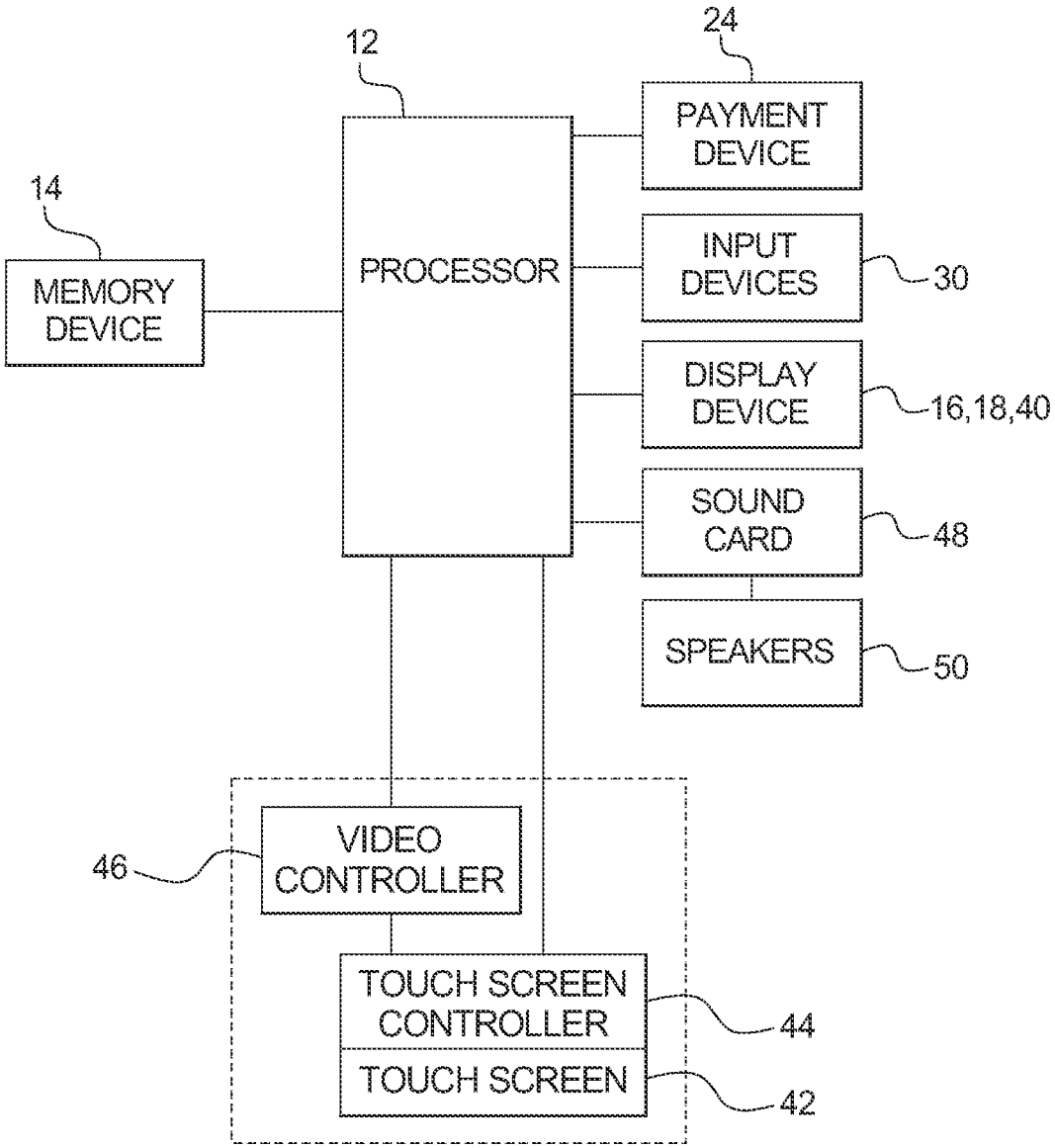
FIG. 2A is a schematic block diagram of the electronic configuration of one embodiment of a gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a hand-held device, such as a personal digital assistant (PDA), a portable computing or mobile device, or another computerized platform to implement the present disclosure. In one embodiment, the gaming device or gaming machine disclosed herein is operable over a wireless network, for example as part of a wireless gaming system. In one such embodiment, the gaming machine may be a hand-held device, a mobile device, or any other suitable wireless device that enables a player to play any suitable game at a variety of different locations. In various embodiments in which the gaming device or gaming machine is a hand-held device, a mobile device, or any other suitable wireless device, at least one memory device and at least one processor which control the game or other operations of the hand-held device, mobile device, or other suitable wireless device may be located: (a) at the hand-held device, mobile device or other suitable wireless device; (b) at a central server or central controller; or (c) any suitable combination of the central server or central controller and the hand-held device, mobile device or other suitable wireless device. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip, a coded magnetic strip or coded rewritable magnetic strip, wherein the programmed microchip or magnetic strips are coded with a player's identification, credit totals (or related data), and/or other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card or smart card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera, in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as the primary or base game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented. In one embodiment, the disclosed multi-dimensional cascading symbol game is implemented as a base or primary game.

In one embodiment, as illustrated in FIGS. 1A and 1B, a base or primary game may be a slot game with one or more paylines 52. In this embodiment, the gaming device includes at least one and preferably a plurality of reels 54, such as three to five reels 54, in either electromechanical form with mechanical rotating reels or video form with simulated reels and movement thereof. Each reel includes one or more symbol display positions. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player.

In one embodiment, one or more of the paylines may be horizontal, vertical, circular, diagonal, angled or any combination thereof. In another embodiment, one or more of the paylines each include a plurality of adjacent symbol display positions on a requisite number of adjacent reels. In one such embodiment, one or more paylines are formed between at least two symbol display positions which are adjacent to each other by either sharing a common side or sharing a common corner (i.e., such paylines are connected paylines). In these embodiments, the gaming device enables a player to wager on one or more of such paylines to activate such wagered on paylines.

In another embodiment wherein one or more paylines are formed between at least two symbol display positions which are adjacent to each other, the gaming device enables a player to wager on and thus activate a plurality of symbol display positions. In this embodiment, one or more paylines which are formed from a plurality of adjacent active symbol display positions on a requisite number of adjacent reels are activated.

In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol display positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol display positions on a first reel by the number of symbols generated in active symbol display positions on a second reel by the number of symbols generated in active symbol display positions on a third reel and so on for each reel of the gaming device with at least one symbol generated in an active symbol display position. For example, a three reel gaming device with three symbols generated in active symbol display positions on each reel includes 27 ways to win (i.e., 3 symbols on the first reel×3 symbols on the second reel×3 symbols on the third reel). A four reel gaming device with three symbols generated in active symbol display positions on each reel includes 81 ways to win (i.e., 3 symbols on the first reel×3 symbols on the second reel×3 symbols on the third reel×3 symbols on the fourth reel). A five reel gaming device with three symbols generated in active symbol display positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol display positions by one or more of the reels modifies the number of ways to win.

In another embodiment, the gaming device enables a player to wager on and thus activate symbol display positions. In one such embodiment, the symbol display positions are on the reels. In this embodiment, if based on the player's wager, a reel is activated, then each of the symbol display positions of that reel will be activated and each of the active symbol display positions will be part of one or more of the ways to win. In one embodiment, if based on the player's wager, a reel is not activated, then a designated number of default symbol display positions, such as a single symbol display position of the middle row of the reel, will be activated and the default symbol display position(s) will be part of one or more of the ways to win. This type of gaming machine enables a player to wager on one, more than one or all of the reels and the processor of the gaming device uses the number of wagered on reels to determine the active symbol display positions and the number of possible ways to win. In alternative embodiments, (1) no symbols are displayed as generated at any of the inactive symbol display positions, or (2) any symbols generated at any inactive symbol display positions may be displayed to the player but suitably shaded or otherwise designated as inactive.

In one embodiment wherein a player wagers on one or more reels, a player's wager of one credit may activate each of the three symbol display positions on a first reel, wherein one default symbol display position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol display positions on a first reel, each of the three symbol display positions on a second reel and each of the three symbol display positions on a third reel wherein one default symbol display position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol display position on a first reel forms part of a winning symbol combination with or is otherwise suitably related to a symbol generated in an active symbol display position on a second reel. In this embodiment, the gaming device classifies each pair of symbols which form part of a winning symbol combination (i.e., each pair of related symbols) as a string of related symbols. For example, if active symbol display positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol display positions (i.e., as opposed to a quantity of awards being based on how many paylines that would have passed through each of the strings of related symbols in active symbol display positions).

In one embodiment, a base or primary game may be a poker game wherein the gaming device enables the player to play a conventional game of video draw poker and initially deals five cards all face up from a virtual deck of fifty-two cards. Cards may be dealt as in a traditional game of cards or in the case of the gaming device, the cards may be randomly selected from a predetermined number of cards. If the player wishes to draw, the player selects the cards to hold via one or more input devices, such as by pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the number of credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand against a payout table and awards are provided to the player.

In one embodiment, a base or primary game may be a keno game wherein the gaming device displays a plurality of selectable indicia or numbers on at least one of the display devices. In this embodiment, the player selects at least one bit potentially a plurality of the selectable indicia or numbers via an input device such as a touch screen. The gaming device then displays a series of drawn numbers and determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or in a bonus or secondary round. In one embodiment, the disclosed multi-dimensional cascading symbol game is implemented as a bonus or secondary game. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central controller 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
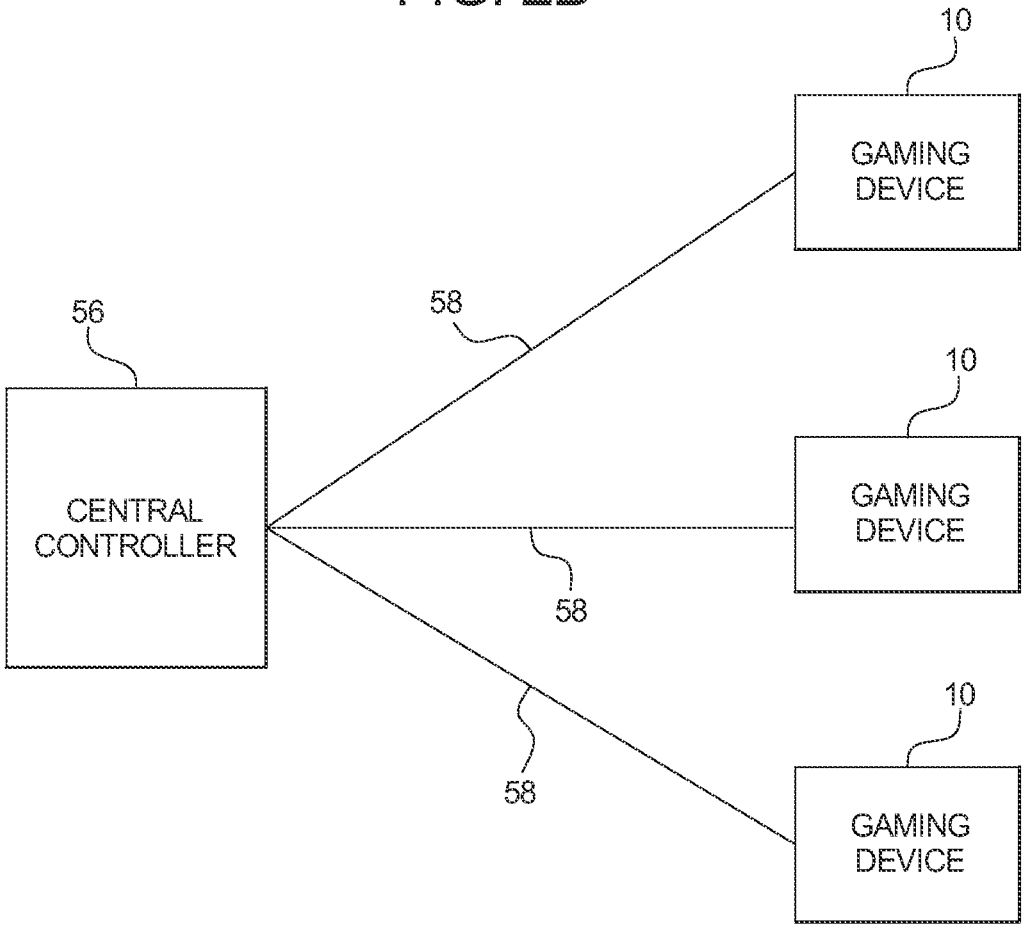
FIG. 2B is a schematic diagram of the central server in communication with a plurality of gaming machines in accordance with one embodiment of the gaming system disclosed herein.

In one embodiment, as illustrated in FIG. 2B, one or more of the gaming devices 10 are in communication with each other and/or at least one central controller 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller, central server or remote host as disclosed herein may be performed by one or more gaming device processors. It should be further appreciated that one, more or each of the functions of one or more gaming device processors as disclosed herein may be performed by the central controller, central server or remote host.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, a predetermined game outcome value is determined for each of a plurality of linked or networked gaming devices based on the results of a bingo, keno, or lottery game. In this embodiment, each individual gaming device utilizes one or more bingo, keno, or lottery games to determine the predetermined game outcome value provided to the player for the interactive game played at that gaming device. In one embodiment, the bingo, keno, or lottery game is displayed to the player. In another embodiment, the bingo, keno or lottery game is not displayed to the player, but the results of the bingo, keno, or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card with each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game, and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of whether the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of players at a plurality of linked gaming devices in a gaming system participate in a group gaming environment. In one embodiment, a plurality of players at a plurality of linked gaming devices work in conjunction with one another, such as by playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Progressive Awards

In various embodiments, the gaming system disclosed herein periodically modifies or shifts the progressive award contribution rate associated with a plurality of different progressive awards. Such a configuration dynamically alters the game play experience for one or more players which increases the amount of excitement and entertainment for such players.

Figure 3:
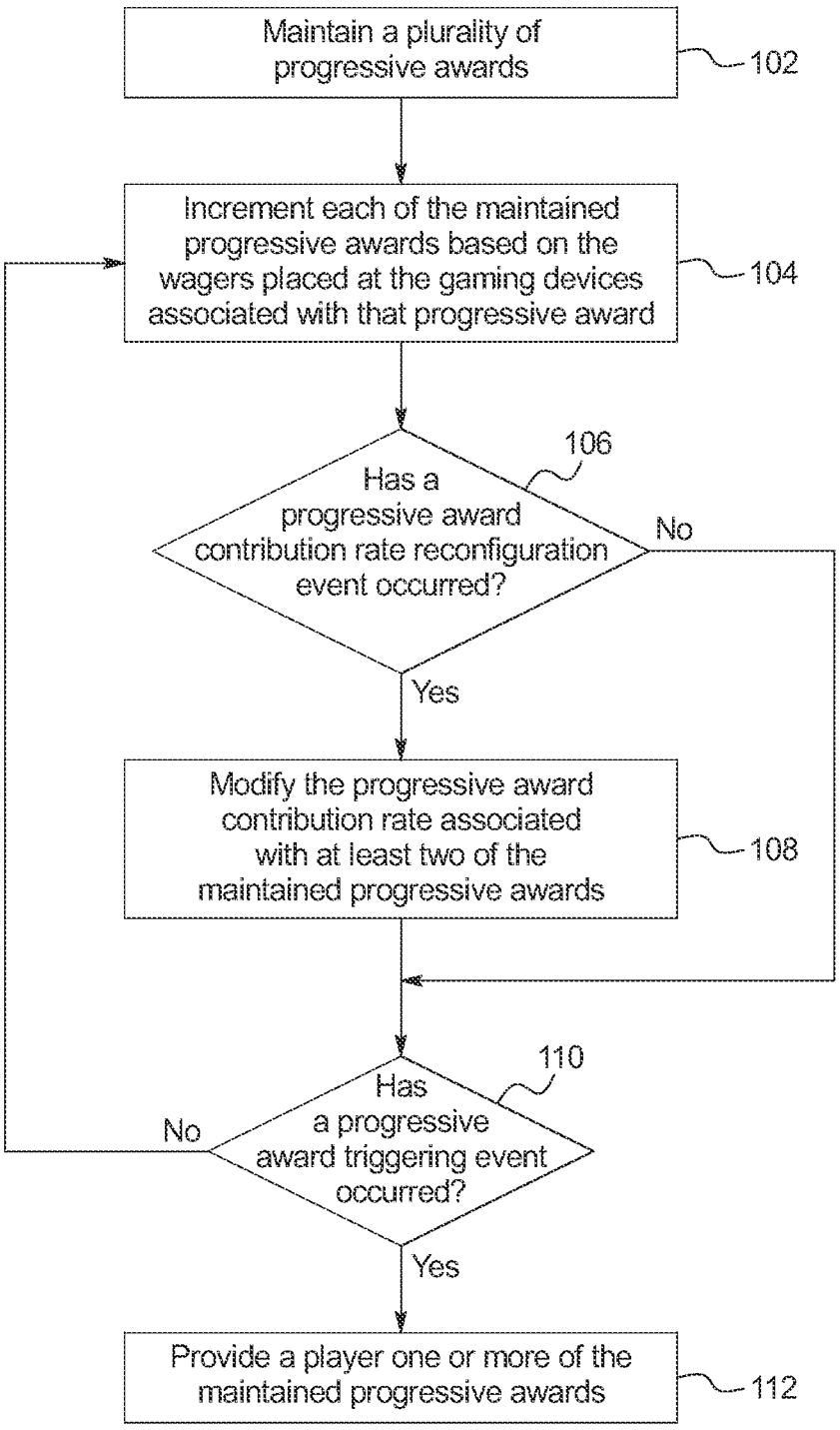
FIG. 3 is a flowchart of one embodiment of the gaming system disclosed herein illustrating the reconfiguration of progressive award contribution rates for a plurality of progressive awards.

Specifically, referring now to FIG. 3, a flowchart of an example embodiment of a process for operating a gaming system or a gaming device disclosed herein is illustrated. In one embodiment, this process is embodied in one or more software programs stored in one or more memories and executed by one or more processors or servers. Although this process is described with reference to the flowchart illustrated in FIG. 3, it should be appreciated that many other methods of performing the acts associated with this process may be used. For example, the order of certain steps described may be changed, or certain steps described may be optional.

In one embodiment, as indicated in block 102, the gaming system maintains a plurality of progressive awards. In one such embodiment, a plurality of gaming devices at one or more gaming sites are networked to the central server in a progressive configuration with the plurality of maintained progressive awards. In another such embodiment, a single or stand-alone gaming device in the gaming system is associated with or otherwise dedicated to the plurality of maintained progressive awards. In another such embodiment, one or more internet accessible dedicated gaming sites are associated with the maintained progressive awards.

In one embodiment, one or more of the progressive awards start at different levels and increment or increase until provided to a player (as described below). For example, the gaming system maintains three progressive awards, wherein the first progressive award has a first reset value (i.e., an initial start value) of $200, the second progressive award has a second reset value of $500 and the third progressive award has a third reset value of $1000.

Each of the progressive awards is associated with a progressive award contribution rate which represent the portion of each wager placed (or the portion of each designated wager, such as a maximum wager, placed) that is allocated to the progressive award. Continuing with the above example, a total of 6% of each wager placed (or 6% of each designated wager placed) is allocated to the three maintained progressive awards, wherein this 6% is broken or divided up into a first progressive award contribution rate of 3%, a second progressive award contribution rate of 2% and a third progressive award contribution rate of 1%. In this example, at a first point in time 202 seen in FIG. 4, the first progressive award has the first progressive award contribution rate of 3% of the wagers placed (or the designated wagers placed) on the gaming devices associated with the first progressive award, the second progressive award has the second progressive award contribution rate of 2% of the wagers placed (or the designated wagers placed) on the gaming devices associated with the second progressive award, and the third progressive award has the third progressive award contribution rate of 1% of the wagers placed (or the designated wagers placed) on the gaming devices associated with the third progressive award.

As seen in block 104 of FIG. 3, the gaming system increments or grows each of the maintained progressive awards based on the wagers placed at the gaming devices associated with that progressive award. Specifically, for each maintained progressive award, the gaming system increments or grows that maintained progressive award based on the wagers placed at the gaming devices associated with that progressive award and the progressive award contribution rate currently associated with that progressive award. Building on the above-described example, for each $1.00 wagered on a gaming device associated with the three maintained progressive awards, the gaming system increments the first progressive award by $0.03 (i.e., $1.00× the first progressive award contribution rate of 3% currently associated with the first progressive award), the gaming system increments the second progressive award by $0.02 (i.e., $1.00× the second progressive award contribution rate of 2% currently associated with the second progressive award), and the gaming system increments the third progressive award by $0.01 (i.e., $1.00× the third progressive award contribution rate of 1% currently associated with the third progressive award). In this example, based on these progressive award contribution rates, the first progressive award (which is associated with the lowest start-up value) will increment or grow quicker than at least the third progressive award (which is associated with the highest start-up value).

It should be appreciated that the displayed progressive award growth rate of a progressive award is determined based on the current progressive award contribution rate associated with that progressive award and an amount of any wagers placed on the plays of the games associated with that progressive award (and any applicable progressive award contribution reserve rate as described below). It should be further appreciated that, as mentioned above, the progressive award contribution rate represents the portion of each wager placed (or the portion of each designated wager placed) that is allocated to the progressive award. Accordingly, while the progressive award growth rate may be variable based on different amounts of wagers placed at different point in time, the progressive award contribution rate associated with a progressive award is constant (until modified as described below) and thus independent of any amounts of any wagers placed.

In addition to incrementing the progressive awards, the gaming system monitors for an occurrence of a progressive award contribution rate reconfiguration event as indicated in diamond 106. In one such embodiment, a progressive award contribution rate reconfiguration event occurs based on at least one displayed event occurring in association with a play of a primary game (e.g., a designated symbol combination being generated). In another such embodiment, a progressive award contribution rate reconfiguration event occurs independent of any displayed events in any plays of any of the primary games (e.g., a mystery event).

If the gaming system determines that a progressive award contribution rate reconfiguration event occurred, the gaming system modifies or reconfigures the progressive award contribution rate associated with at least two of the maintained progressive awards as indicated in block 108. That is, upon a designated triggering condition being satisfied, the gaming system shifts which of the progressive award contribution rates are associated with which progressive awards and thus shifts the percentage of each wager that is allocated to a plurality of the progressive awards.

Utilizing the above-described example, upon an occurrence of a progressive award contribution rate reconfiguration event, the gaming system modifies, changes or shifts which of the three maintained progressive awards are associated with which of the progressive award contribution rates. In this example as seen in FIG. 4, at a second point in time 204, following $1000 being wagered on the primary games associated with the progressive awards and following such modifications of the progressive award contribution rates, the first progressive award has the second progressive award contribution rate of 2% of the wagers placed (or the designated wagers placed) on the gaming devices associated with the first progressive award, the second progressive award has the third progressive award contribution rate of 1% of the wagers placed (or the designated wagers placed) on the gaming devices associated with the second progressive award, and the third progressive award has the first progressive award contribution rate of 3% of the wagers placed (or the designated wagers placed) on the gaming devices associated with the third progressive award.

It should be appreciated that the shifting of which progressive award contribution rates are associated with which progressive awards dynamically alters the MLP configuration described above. Specifically, by periodically shifting the relatively largest progressive award contribution rate from relatively smaller maintained progressive awards to relatively larger maintained progressive award, such relatively larger progressive awards will grow in value at a more rapid rate and thus increase the level of excitement and entertainment for certain players that play the gaming devices for a chance to win the top or relatively larger valued progressive awards.

In one embodiment, the gaming system modifies the progressive award contribution rate associated with each of the maintained progressive awards. In another embodiment, the gaming system modifies the progressive award contribution rate associated with a plurality of, but not each of the maintained progressive awards.

In one embodiment, the gaming system modifies the progressive award contribution rates associated with a plurality of the maintained progressive awards by swapping which of the progressive award contribution rates are associated with which maintained progressive awards. In another embodiment, the gaming system modifies the progressive award contribution rates associated with a plurality of the maintained progressive awards by disassociating one or more of the maintained progressive awards with their current progressive award contribution rates and reassociating such maintained progressive awards with different, previously unassociated progressive award contribution rates. In another embodiment, the gaming system modifies the progressive award contribution rates associated with a plurality of the maintained progressive awards by: (i) swapping which of at least two of the progressive award contribution rates are associated with which of at least two of the maintained progressive awards, and (ii) disassociating one or more of the maintained progressive awards with their current progressive award contribution rates and reassociating such maintained progressive awards with different, previously unassociated progressive award contribution rates.

In one embodiment, the gaming system modifies the progressive award contribution rates associated with a plurality of the maintained progressive awards without any intervention by any player or any gaming establishment operator, such as any casino employee. In this embodiment, upon the occurrence of a progressive award contribution rate reconfiguration event, the gaming system automatically modifies the progressive award contribution rates associated with a plurality of the maintained progressive awards.

Returning to FIG. 3, if: (i) the gaming system determines that a progressive award contribution rate reconfiguration event did not occur, or (ii) following the occurrence of the progressive award contribution rate reconfiguration event and the subsequent reconfiguration or modification of the progressive award contribution rates associated with at least two of the progressive awards, the gaming system proceeds to diamond 110 of FIG. 3 and determines whether a progressive award triggering event has occurred. In one such embodiment, a progressive award triggering event occurs based on at least one displayed event occurring in association with a play of a primary game (e.g., a designated symbol combination being generated). In another such embodiment, a progressive award triggering event occurs independent of any displayed events in any plays of any of the primary games (e.g., a mystery event).

If the gaming system determines that a progressive award triggering event did not occur, the gaming system returns to block 104 and continues to increment the progressive awards as described above. For example, after determining that the progressive award triggering event did not occur, the gaming system subsequently determined that another progressive award contribution rate triggering event occurred and modified, changed or shifted which of the three maintained progressive awards are associated with which of the progressive award contribution rates. In this example as seen in FIG. 4, at a third point in time 206, following another $1000 being wagered on the primary games associated with the progressive awards and following this subsequent modification of the progressive award contribution rates, the first progressive award has the second progressive award contribution rate of 2% of the wagers placed (or the designated wagers placed) on the gaming devices associated with the first progressive award, the second progressive award has the third progressive award contribution rate of 3% of the wagers placed (or the designated wagers placed) on the gaming devices associated with the second progressive award, and the third progressive award has the first progressive award contribution rate of 1% of the wagers placed (or the designated wagers placed) on the gaming devices associated with the third progressive award.

It should be appreciated that since the last progressive award contribution rate reconfiguration event, the third progressive award (i.e., the largest progressive award) has been associated with the progressive award contribution rate of 3% (i.e., the largest progressive award contribution rate). Thus, between the second and third points in time, the largest progressive award has also grown the quickest. Such a configuration combats jackpot fatigue associated with the top progressive award and thus provides increased excitement and entertainment for certain players.

On the other hand, if the gaming system determines that a progressive award triggering event has occurred, the gaming system provides a player one or more of the maintained progressive awards as indicated in block 112. For example, as seen in FIG. 4, at a fourth point in time 208, following another $1000 being wagered on the primary games associated with the progressive awards, a progressive award triggering event occurred, the second progressive award currently valued at $560 is provided to a player and resets back to the initial progressive award value of $500 (not shown).

In one embodiment, upon the occurrence of a progressive award contribution rate reconfiguration event, the gaming system randomly determines which progressive award contribution rate to associate with which maintained progressive award. In another embodiment, upon the occurrence of a progressive award contribution rate reconfiguration event, the gaming system determines which progressive award contribution rate to associate with which maintained progressive award based on a predetermined shifting schedule. For example, each progressive award contribution rate will shift down one level of the MLP to the next progressive award (with the progressive award contribution rate of the last or bottom level of the MLP shifting to the first or top level of the MLP).

In one embodiment, a progressive award contribution rate reconfiguration event occurs based on a quantity of games played by the gaming device(s) associated with the maintained progressive awards. In one such embodiment, the gaming system determines a quantity of games played prior to each progressive award contribution rate reconfiguration event and tracks the quantity of games played. In this embodiment, when the tracked quantity of games played reached the determined quantity of games played, the gaming system causes a progressive award contribution rate reconfiguration event to occur and proceeds with shifting or shuffling which progressive awards are associated with which progressive award contribution rates. For example, if the gaming system determines that a progressive award contribution rate reconfiguration event will occur every fifty games played, then prior to the fiftieth game being played, progressive award A is associated with a 1% contribution rate, progressive award B is associated with a 2% contribution rate and progressive award C is associated with a 3% contribution rate. In this example, after the fiftieth game is played (and thus after the occurrence of the progressive award contribution rate reconfiguration event has occurred), the gaming system shifts or shuffles the progressive award contribution rates such that progressive award A is associated with a 3% contribution rate, progressive award B is associated with a 1% contribution rate and progressive award C is associated with a 2% contribution rate.

In another embodiment, the gaming system determines a plurality of different quantities of games played and utilizes such different quantities at different points in time to cause progressive award contribution rate reconfiguration events to occur. Such a configuration provides an increased level of volatility in the modifications of the different progressive award contribution rates associated with the different maintained progressive awards. For example, the gaming system determines the quantities of fifty games played, twenty-five games played and fifteen games played. In this example, the gaming system causes: (i) a first progressive award contribution rate reconfiguration event to occur after the fiftieth game is played at one or more gaming devices associated with the maintained progressive awards, (ii) a second progressive award contribution rate reconfiguration event to occur after the twenty-fifth game is played at one or more gaming devices associated with the maintained progressive awards, and (iii) a third progressive award contribution rate reconfiguration event to occur after the fifteenth game is played at one or more gaming devices associated with the maintained progressive awards.

In another embodiment, the gaming system utilizes a weighted table of different quantities of games played to determine when one or more progressive award contribution rate reconfiguration events will occur. In this embodiment, each of the quantities of games played is associated with a probability wherein a quantity of games played is randomly selected, based on the associated probabilities and when that selected quantity of games are played, the gaming system causes a progressive award contribution rate reconfiguration event to occur. Following such an occurrence of a progressive award contribution rate reconfiguration event, the gaming system randomly selects, from the weighted table, another quantity of games played and proceeds as described above.

In another embodiment, a progressive award contribution rate reconfiguration event occurs based on one or more periods of time. In this embodiment, similar to the above-described embodiments regarding a progressive award contribution rate reconfiguration event occurring based on a quantity of games played, the gaming system selects one or more periods of time for one or more progressive award contribution rate reconfiguration events. When the period of time for a progressive award contribution rate reconfiguration event expires or has elapsed, the gaming system causes a progressive award contribution rate reconfiguration event to occur.

In another embodiment, as mentioned above, (i) a progressive award contribution rate reconfiguration event occurs, and/or (ii) a progressive award triggering event occurs, based on an outcome associated with one or more plays of any primary game and/or an outcome associated with one or more plays of any secondary game of the gaming devices in the gaming system. In one embodiment, such determinations are symbol driven based on the generation of one or more designated symbols or symbol combinations.

In another embodiment, as also mentioned above, the gaming system does not provide any apparent reasons to the players for (i) causing a progressive award contribution rate reconfiguration event to occur, and/or (ii) causing a progressive award triggering event to occur. In these embodiments, such determinations are not triggered by an event in a primary game or based specifically on any of the plays of any primary game or on any of the plays of any secondary game of the gaming devices in the system. That is, these events occur without any explanation or alternatively with simple explanations.

In one embodiment, (i) a progressive award contribution rate reconfiguration event occurs, and/or (ii) a progressive award triggering event occurs, based on an amount coin-in. In this embodiment, the gaming system determines if an amount of coin-in wagered at one or more gaming devices in the gaming system reaches or exceeds a designated amount of coin-in (i.e., a threshold coin-in amount). Upon the amount of coin-in wagered at one or more gaming devices in the gaming system reaching or exceeding the bonus threshold coin-in amount, the gaming system causes one or more of such events or conditions to occur. For example three separate progressive awards start $1,000,000, $2,000,000 and $3,000,000 wherein the progressive award which started at $3,000,000 increments at 3% until it reaches $10,000,000, at which point a progressive award contribution rate reconfiguration event occurs and the progressive award which started at $2,000,000 increments at 3% while the remaining progressive awards increment at 1.5%. In this example, when the progressive award that started at $2,000,000 reaches $10,000,000, another progressive award contribution rate reconfiguration event occurs. In this example, after each progressive awards reach at least $10,000,000 the threshold coin-in amount is increased and this process repeats. In different embodiments, the threshold coin-in amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another alternative embodiment, (i) a progressive award contribution rate reconfiguration event occurs, and/or (ii) a progressive award triggering event occurs, based on an amount coin-out. In this embodiment, the gaming system determines if an amount of coin-out provided by one or more gaming devices in the gaming system reaches or exceeds a designated amount of coin-out (i.e., a threshold coin-out amount). Upon the amount of coin-out provided at one or more gaming devices in the gaming system reaching or exceeding the threshold coin-out amount, the gaming system causes one or more of such events or conditions to occur. In different embodiments, the threshold coin-out amount is predetermined, randomly determined, determined based on a player's status (such as determined through a player tracking system), determined based on a generated symbol or symbol combination, determined based on a random determination by the central controller, determined based on a random determination at the gaming device, determined based on one or more side wagers placed, determined based on the player's primary game wager, determined based on time (such as the time of day) or determined based on any other suitable method or criteria.

In another alternative embodiment, (i) a progressive award contribution rate reconfiguration event occurs, and/or (ii) a progressive award triggering event occurs, based on a predefined variable reaching a defined parameter threshold. For example, when the 500,000$^{th}$ player has played a gaming device of the gaming system (ascertained from a player tracking system), one or more of such events or conditions occur. In different embodiments, the predefined parameter thresholds include a length of time, a length of time after a certain dollar amount is hit, a wager level threshold for a specific device (which gaming device is the first to contribute $250,000), a number of gaming devices active, or any other parameter that defines a suitable threshold.

In another alternative embodiment, as described above in relation to an occurrence of a progressive award contribution rate reconfiguration event occurring, (i) a progressive award contribution rate reconfiguration event occurs, and/or (ii) a progressive award triggering event occurs, based on a quantity of games played. In this embodiment, a quantity of games played is set for when one or more of such events or conditions will occur. In one embodiment, such a set quantity of games played is based on historic data.

In another alternative embodiment, as described above in relation to an occurrence of a progressive award contribution rate reconfiguration event occurring, (i) a progressive award contribution rate reconfiguration event occurs, and/or (ii) a progressive award triggering event occurs, based on time. In this embodiment, a time is set for when one or more of such events or conditions will occur. In one embodiment, such a set time is based on historic data.

In another alternative embodiment, (i) a progressive award contribution rate reconfiguration event occurs, and/or (ii) a progressive award triggering event occurs, based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the gaming system recognizes the player's identification (via the player tracking system) when the player inserts or otherwise associates their player tracking card in the gaming device. The gaming system determines the player tracking level of the player and if the current player tracking level defined by the gaming system operator is eligible for one or more of such events or conditions. In one embodiment, the gaming system operator defines minimum bet levels required for such events or conditions to occur based on the player's card level.

In another alternative embodiment, (i) a progressive award contribution rate reconfiguration event occurs, and/or (ii) a progressive award triggering event occurs, based on a system determination, including one or more random selections by the central controller. In one embodiment, as described above, the central controller tracks all active gaming devices and the wagers they placed. In one such embodiment, based on the gaming device's state as well as one or more wager pools associated with the gaming device, the central controller determines whether to one or more of such events or conditions will occur. In one such embodiment, the player who consistently places a higher wager is more likely to be associated with an occurrence of one or more of such events or conditions than a player who consistently places a minimum wager. It should be appreciated that the criteria for determining whether a player is in active status or inactive status for determining if one or more of such events occur may the same as, substantially the same as, or different than the criteria for determining whether a player is in active status or inactive status for another one of such events to occur.

In another alternative embodiment, (i) a progressive award contribution rate reconfiguration event occurs, and/or (ii) a progressive award triggering event occurs, based on a determination of if any numbers allotted to a gaming device match a randomly selected number. In this embodiment, upon or prior to each play of each gaming device, a gaming device selects a random number from a range of numbers and during each primary game, the gaming device allocates the first N numbers in the range, where N is the number of credits bet by the player in that primary game. At the end of the primary game, the randomly selected number is compared with the numbers allocated to the player and if a match occurs, one or more of such events or conditions occur. It should be appreciated that any suitable manner of causing a progressive award contribution rate reconfiguration event to occur, and/or causing a progressive award triggering event to occur may be implemented in accordance with the gaming system and method disclosed herein.

It should be appreciated that any of the above-described progressive award contribution rate reconfiguration events or progressive award triggering events may be combined in one or more different embodiments.

In one embodiment, as a plurality of players place wagers on the plays of the primary games and as a portion of such wagers are allocated to one or more progressive awards, the gaming system banks part or all of these allocated amounts. That is, rather than contributing the entire portion of each wager placed that is allocated for a progressive award directly to the progressive award as such wagers are placed, the gaming system reserves at least part of this portion and subsequently contributes the reserved portion to the progressive award at a later point in time. Such a configuration spreads out the growth of the progressive award over time such that even at one or more points in time when no wagers are placed, one or more progressive awards still grow in value. Put differently, to insure that the growth of a progressive award that is displayed to one or more players increases at a relative constant rate over a designated period of time, the gaming system banks part or all of certain contribution amounts to the progressive award. With this background, it should be appreciated that the modification of a progressive award contribution rate associated with a progressive award modifies the portion of each wager placed that is reserved for subsequent allocation to a progressive award (i.e., modifies the progressive award contribution reserve rate) and thus modifies the growth of a progressive award that is displayed to one or more players (i.e., modifies the displayed progressive award growth rate).

In one embodiment, different progressive awards are associated with different numbers of gaming devices. For example, a progressive award valued at $10,000 may be associated with ten gaming devices while another progressive award valued at $500,000 may be associated with one-hundred gaming devices. In one embodiment, the multiple gaming devices may be in the same bank of devices, in the same casino or gaming establishment (such as through LAN), or in two or more different casinos or gaming establishments (such as through a WAN). In another embodiment, each individual gaming device maintains one or more progressive awards wherein a portion of the wagers placed at that respective gaming device is allocated to one or more progressive awards maintained by such individual gaming device. In another embodiment, each individual gaming device maintains one or more progressive awards and the central server simultaneously or substantially simultaneously maintains one or more progressive awards. In one such embodiment, the lower valued, more frequently triggered progressive awards are maintained by the individual gaming devices and the higher valued, less frequently triggered progressive awards are maintained by the central server. In one embodiment, a portion of each wager placed at a designated gaming device is allocated to one or more progressive awards associated with that designated gaming device. In another embodiment, a portion designated wagers placed at a designated gaming device, such as a portion of each maximum wager placed or a portion of each side wager placed, is allocated to one or more progressive awards associated with that designated gaming device.

In one embodiment, a master host site computer is coupled to a plurality of the central servers at a variety of mutually remote gaming sites for providing a multi-site linked progressive automated gaming system. In one embodiment, a master host site computer may serve gaming devices distributed throughout a number of properties at different geographical locations including, for example, different locations within a city or different cities within a state. In one embodiment, the master host site computer is maintained for the overall operation and control of the system. In this embodiment, a master host site computer oversees all or part of the progressive gaming system and is the master for computing all or part of the progressive jackpots. All participating gaming sites report to, and receive information from, the master host site computer. Each central server computer is responsible for all data communication between the gaming device hardware and software and the master host site computer.

In one embodiment, different gaming devices in the gaming system have different progressive awards available to the player. In one such embodiment, different types of gaming devices are associated with different types of progressive awards based on the current configuration of the gaming system. In one embodiment, zero, one or more progressive awards may be associated with each of the gaming devices in the gaming system while zero, one or more different progressive awards may be associated with a plurality of, but not all of the gaming devices in the gaming system.

In one embodiment, one or more of the progressive awards are each funded, at least in part, via a side bet or side wager. In one such embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount on any payline (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner. In one such embodiment, one or more progressive awards are funded, at least partially, via an amount provided by one or more marketing and/or advertising departments, such as a casino's marketing department.

In one alternative embodiment, a minimum wager level is required for a gaming device to qualify to be selected to obtain one of the progressive awards. In one embodiment, this minimum wager level is the maximum wager level for the primary game in the gaming device. In another embodiment, this minimum wager level is placing a wager on all available paylines in a slot primary game or alternatively placing a wager on all available poker hands in a multi-hand poker primary game. In another embodiment, no minimum wager level is required for a gaming device to qualify to be selected to obtain one of the progressive awards.

It should be appreciated that in different embodiments, one or more of:

i. a quantity of maintained progressive awards;
ii. a quantity of maintained progressive awards associated with modifiable progressive award contribution rates;
iii. a quantity of progressive award contribution rates which may be associated with the progressive awards;
iv. a determination of which progressive awards will be associated with which progressive award contribution rates upon an occurrence of a progressive award contribution rate reconfiguration event;
v. a quantity of games played between progressive award contribution rate reconfiguration events;
vi. an amount of time between progressive award contribution rate reconfiguration events;
vii. a frequency which each progressive award contribution rate reconfiguration event occurs;
viii. any determination disclosed herein;

is/are predetermined, randomly determined, determined based on a generated symbol or symbol combination, determined based on a random determination by the central controller, determined based on a random determination at the gaming system, determined based on a player's selection, determined based on one or more side wagers placed, determined based on the player's primary game wager, determined based on time (such as the time of day), determined based on an amount of coin-in accumulated in one or more pools, determined based on a status of the player (i.e., a player tracking status), or determined based on any other suitable method or criteria.

Information Provided to Player

Figure 5:
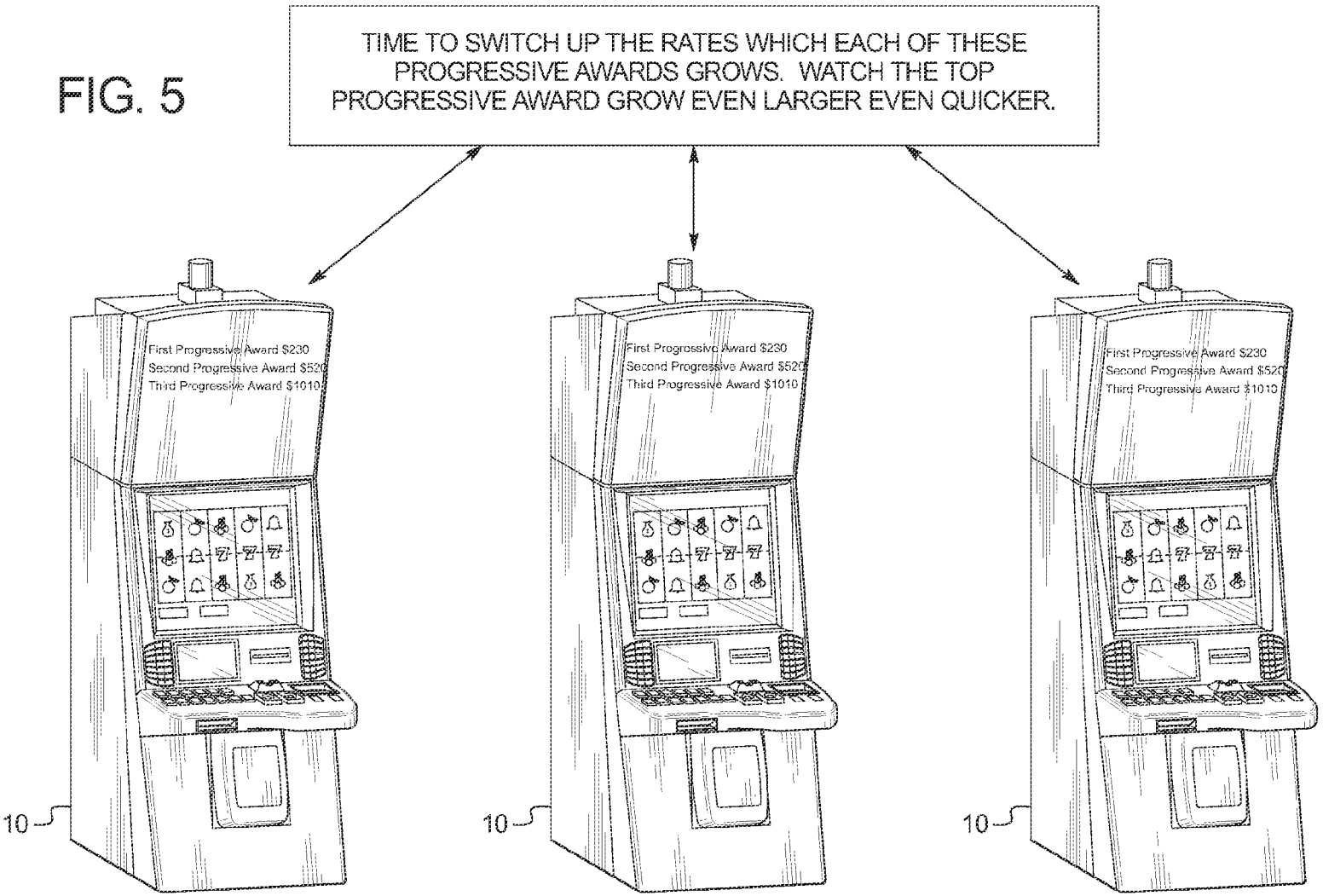
FIG. 5 is a front perspective view of one embodiment of the gaming system disclosed herein illustrating a plurality of gaming devices and a community display device displaying information relating to the occurrence of a progressive award contribution rate reconfiguration event.

In one embodiment, when modifying the progressive award contribution rate associated with one or more progressive awards, the gaming system displays suitable information about such modifications through one or more displays on the gaming devices or additional information displays positioned near the gaming devices (such as above a bank of gaming devices) or remote from the gaming devices (such as at a different location in a casino). These displays indicate to one or more players (or potential players) that the progressive award contribution rates of a plurality of progressive awards has changed. For example, as seen in FIG. 5, if the gaming system maintains three different progressive awards and determines to modify the progressive award contribution rate associated with these three progressive awards, the gaming device displays appropriate messages such as "TIME TO SWITCH UP THE RATES WHICH EACH OF THESE PROGRESSIVE AWARDS GROWS" and "WATCH THE TOP PROGRESSIVE AWARD GROW EVEN LARGER EVEN QUICKER" to the player visually, or through suitable audio or audiovisual displays. It should be appreciated that any information disclosed herein related to any maintained progressive award, any progressive award contribution rate and/or any progressive award contribution rate reconfiguration event can be provided to the players through any suitable audio, audio-visual or visual devices.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

at least one controller configured to communicate with at least one gaming device including a housing, a plurality of input devices supported by the housing, said plurality of input devices including an acceptor, and a cashout device, a display device supported by the housing, at least one processor and at least one memory device which stores a plurality of instructions, which when executed by the at least one processor, cause the at least one processor to operate with said display device and said plurality of input devices to: (a) if a physical item is received via the acceptor, establish a credit balance based, at least in part, on a monetary value associated with the received physical item, and if a cashout input is received via the cashout device, cause an initiation of any payout associated with the credit balance, said at least one controller programmed to:

(a) maintain a plurality of different progressive awards, each progressive award associated with a progressive award contribution rate;

(b) cause each of the maintained progressive awards to be displayed;

(c) for at least one of the progressive awards, increment said progressive award, wherein an amount of said increment is based on: (i) at least one wager placed on at least one play of a primary game of said at least one gaming device, and (ii) the progressive award contribution rate associated with said progressive award;

(d) determine if a progressive award contribution rate reconfiguration event occurs;

(e) if said progressive award contribution rate reconfiguration event occurs, modify the progressive award contribution rates associated with at least two of the progressive awards; and (f) if a progressive award triggering event occurs, provide at least one of the displayed progressive awards to at least one player of said at least one gaming device.

2. The gaming system of claim 1, wherein if said progressive award contribution rate reconfiguration event occurs, the at least one controller is programmed to automatically modify the progressive award contribution rates associated with at least two of the progressive awards.

3. The gaming system of claim 1, wherein if said progressive award contribution rate reconfiguration event occurs, the at least one controller is programmed to modify the progressive award contribution rates associated with each of the progressive awards.

4. The gaming system of claim 1, wherein the at least one controller is programmed to repeat (c) to (e) at least once.

5. The gaming system of claim 1, wherein the at least one controller is programmed to cause the progressive award contribution rate reconfiguration event to occur after a designated quantity of plays of the primary game.

6. A gaming system comprising:

at least one controller configured to communicate with at least one gaming device including a housing, a plurality of input devices supported by the housing, said plurality of input devices including an acceptor, and a cashout device, a display device supported by the housing, at least one processor and at least one memory device which stores a plurality of instructions, which when executed by the at least one processor, cause the at least one processor to operate with said display device and said plurality of input devices to: La) if a physical item is received via the acceptor, establish a credit balance based, at least in part, on a monetary value associated with the received physical item, and if a cashout input is received via the cashout device, cause an initiation of any payout associated with the credit balance, said at least one controller programmed to:

(a) during a first period of time:

(i) maintain a plurality of different progressive awards, wherein at least a first one of the progressive awards is associated with a first progressive award contribution rate and a second one of the progressive awards is associated with a second, different progressive award contribution rate, (ii) cause each of the maintained progressive awards to be displayed, (iii) increment the first one of the progressive awards, wherein an amount of said increment is based on the first progressive award contribution rate, and (iv) increment the second one of the progressive awards, wherein an amount of said increment is based on the second progressive award contribution rate; and (b) during a second, subsequent period of time after an occurrence of a progressive award contribution rate reconfiguration event:

(i) maintain the plurality of different progressive awards, wherein at least the first one of the progressive awards is associated with the second, different progressive award contribution rate and the second one of the progressive awards is associated with the first progressive award contribution rate, (ii) cause each of the maintained progressive awards to be displayed, (iii) increment the first one of the progressive awards, wherein an amount of said increment is based on the second progressive award contribution rate, and (iv) increment the second one of the progressive awards, wherein an amount of said increment is based on the first progressive award contribution rate.

7. The gaming system of claim 6, wherein a first wager is placed in association with the play of the primary game during the first period of time, the amount of said increment of the first one of the progressive awards is based on an amount of the first wager placed, and an amount of said increment of the second one of the progressive awards is based on the amount of the first wager placed.

8. The gaming system of claim 7, wherein a second wager is placed in association with the play of the primary game during the second period of time, the amount of said increment of the first one of the progressive awards is based on an amount of the second wager placed, and an amount of said increment of the second one of the progressive awards is based on the amount of the second wager placed.

9. The gaming system of claim 6, wherein if the amount of the wagers placed during the first period of time and the second period of time are the same, the at least one controller is programmed to increment the first one of the progressive awards by different amounts during the first period of time and the second period of time.

10. The gaming system of claim 6, wherein if the amount of the wagers placed during the first period of time and the second period of time are different, the at least one controller is programmed to increment the first one of the progressive awards by the same amount during the first period of time and the second period of time.

11. The gaming system of claim 6, wherein at during a third, subsequent period of time after another occurrence of the progressive award contribution rate reconfiguration event, the at least one controller is programmed to:

(i) maintain the plurality of different progressive awards, wherein at least the first one of the progressive awards is associated with the first progressive award contribution rate and the second one of the progressive awards is associated with the second, different progressive award contribution rate, and (ii) for a wager placed in association with a play of the primary game during the third period of time:

(A) increment the first one of the progressive awards, wherein an amount of said increment is based on: (I) an amount of the wager placed, and (II) the first progressive award contribution rate, and (B) increment the second one of the progressive awards, wherein an amount of said increment is based on: (I) the amount of the wager placed, and (II) the second progressive award contribution rate.

12. The gaming system of claim 6, wherein the progressive award contribution rate reconfiguration event occurs after a designated quantity of plays of the primary game.

13. The gaming system of claim 6, wherein the at least one controller is programmed to provide at least one of the progressive awards to at least one player of said at least one gaming device if a progressive award triggering event occurs during a third, subsequent period of time.

14. A method of operating a gaming system, said method comprising:

(a) causing at least one processor to execute a plurality of instructions to maintain a plurality of different progressive awards, each progressive award associated with a progressive award contribution rate;

(b) causing each of the maintained progressive awards to be displayed;

(c) for at least one of the progressive awards, causing the at least one processor to execute the plurality of instructions to increment said progressive award, wherein an amount of said increment is based on: (i) at least one wager placed on at least one play of a primary game of at least one gaming device, and (ii) the progressive award contribution rate associated with said progressive award;

(d) causing the at least one processor to execute the plurality of instructions to determine if a progressive award contribution rate reconfiguration event occurs;

(e) if said progressive award contribution rate reconfiguration event occurs, causing the at least one processor to execute the plurality of instructions to modify the progressive award contribution rates associated with at least two of the progressive awards; and (f) if a progressive award triggering event occurs, providing at least one of the displayed progressive awards to at least one player of said at least one gaming device, wherein a credit balance of said at least one gaming device is increasable based on the provided at least one of the displayed progressive awards, said credit balance being increasable via an acceptor of a physical item associated with a monetary value, and said credit balance being decreasable via a cashout device configured to receive an input to cause an initiation of a payout associated with the credit balance.

15. The method of claim 14, which includes causing the at least one processor to execute the plurality of instructions to automatically modify the progressive award contribution rates associated with at least two of the progressive awards if said progressive award contribution rate reconfiguration event occurs.

16. The method of claim 14, which includes causing the at least one processor to execute the plurality of instructions to modify the progressive award contribution rates associated with each of the progressive awards if said progressive award contribution rate reconfiguration event occurs.

17. The method of claim 14, which includes causing the at least one processor to execute the plurality of instructions to repeat (c) to (e) at least once.

18. The method of claim 14, which includes causing the at least one processor to execute the plurality of instructions to cause the progressive award contribution rate reconfiguration event to occur after a designated quantity of plays of the primary game.

19. The method of claim 14, which is provided through a data network.

20. The method of claim 19, wherein the data network is an internet.

21. A method of operating a gaming system, said method comprising:

(a) during a first period of time:

(i) causing at least one processor to execute a plurality of instructions to maintain a plurality of different progressive awards, wherein at least a first one of the progressive awards is associated with a first progressive award contribution rate and a second one of the progressive awards is associated with a second, different progressive award contribution rate, (ii) causing each of the maintained progressive awards to be displayed, wherein if at least one of the maintained progressive awards were to be provided, a credit balance is increasable based on the provided at least one of the displayed progressive awards, said credit balance being increasable via an acceptor of a physical item associated with a monetary value, and said credit balance being decreasable via a cashout device configured to receive an input to cause an initiation of a payout associated with the credit balance, (iii) causing the at least one processor to execute the plurality of instructions to increment the first one of the progressive awards, wherein an amount of said increment is based on the first progressive award contribution rate, and (iv) causing the at least one processor to execute the plurality of instructions to increment the second one of the progressive awards, wherein an amount of said increment is based on the second progressive award contribution rate; and (b) during a second, subsequent period of time after an occurrence of a progressive award contribution rate reconfiguration event:

(i) causing the at least one processor to execute the plurality of instructions to maintain the plurality of different progressive awards, wherein at least the first one of the progressive awards is associated with the second, different progressive award contribution rate and the second one of the progressive awards is associated with the first progressive award contribution rate, (ii) causing each of the maintained progressive awards to be displayed, (iii) causing the at least one processor to execute the plurality of instructions to increment the first one of the progressive awards, wherein an amount of said increment is based on the second progressive award contribution rate, and (iv) causing the at least one processor to execute the plurality of instructions to increment the second one of the progressive awards, wherein an amount of said increment is based on the first progressive award contribution rate.

22. The method of claim 21, wherein a first wager is placed in association with the play of the primary game during the first period of time, the amount of said increment of the first one of the progressive awards is based on an amount of the first wager placed, and an amount of said increment of the second one of the progressive awards is based on the amount of the first wager placed.

23. The method of claim 22, wherein a second wager is placed in association with the play of the primary game during the second period of time, the amount of said increment of the first one of the progressive awards is based on an amount of the second wager placed, and an amount of said increment of the second one of the progressive awards is based on the amount of the second wager placed.

24. The method of claim 21, which includes causing the at least one processor to execute the plurality of instructions to increment the first one of the progressive awards by different amounts during the first period of time and the second period of time if the amount of the wagers placed during the first period of time and the second period of time are the same.

25. The method of claim 21, which includes causing the at least one processor to execute the plurality of instructions to increment the first one of the progressive awards by the same amount during the first period of time and the second period of time if the amount of the wagers placed during the first period of time and the second period of time are different.

26. The method of claim 21, which includes, during a third, subsequent period of time after another occurrence of the progressive award contribution rate reconfiguration event:

(i) causing the at least one processor to execute the plurality of instructions to maintain the plurality of different progressive awards, wherein at least the first one of the progressive awards is associated with the first progressive award contribution rate and the second one of the progressive awards is associated with the second, different progressive award contribution rate, (ii) causing each of the maintained progressive awards to be displayed, and (iii) for a wager placed in association with a play of the primary game during the third period of time:

(A) causing the at least one processor to execute the plurality of instructions to increment the first one of the progressive awards, wherein an amount of said increment is based on: (I) an amount of the wager placed, and (II) the first progressive award contribution rate, and (B) causing the at least one processor to execute the plurality of instructions to increment the second one of the progressive awards, wherein an amount of said increment is based on: (I) the amount of the wager placed, and (II) the second progressive award contribution rate.

27. The method of claim 21, which includes causing the at least one processor to execute the plurality of instructions to cause the progressive award contribution rate reconfiguration event to occur after a designated quantity of plays of the primary game.

28. The method of claim 17, which includes providing at least one of the progressive awards to at least one player of said at least one gaming device if a progressive award triggering event occurs during a third, subsequent period of time.

29. The method of claim 21, which is provided through a data network.

30. The method of claim 29, wherein the data network is an internet.

* * * * *